United States Patent [19]

Rosenberg

[11] 4,061,547

[45] Dec. 6, 1977

[54] ACIDIC PLATING BATH AND ADDITIVES FOR ELECTRODEPOSITION OF BRIGHT TIN

[75] Inventor: William E. Rosenberg, Strongsville, Ohio

[73] Assignee: Columbia Chemical Corporation, Cleveland, Ohio

[21] Appl. No.: 707,437

[22] Filed: July 21, 1976

Related U.S. Application Data

[63] Continuation-in-part of Ser. No. 593,311, July 7, 1975, Pat. No. 3,977,949.

[51] Int. Cl.[2] ..... C25D 3/32

[52] U.S. Cl. ..... 204/54 R; 204/DIG. 2; 260/511; 260/600 R; 252/79.1

[58] Field of Search ..... 204/54 R, 54 L, 435, 204/DIG. 2; 260/600 R, 511

[56] References Cited

U.S. PATENT DOCUMENTS

| | | | |
|---|---|---|---|
| 3,956,123 | 5/1976 | Rosenberg et al. | 204/54 R |
| 3,977,949 | 8/1976 | Rosenberg | 204/54 R |

*Primary Examiner*—G. L. Kaplan

*Attorney, Agent, or Firm*—Oldham & Oldham Co.

[57] ABSTRACT

An aqueous acid tin electroplating bath contains as a brightening agent compounds having the formula:

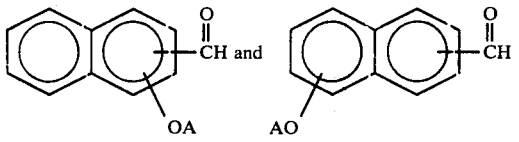

where O is oxygen and A is selected from the class consisting of hydrogen, hydroxy alkyl, polyalkoxy, and 3-sulfopropyl, certain emulsifying agents and certain synergistically acting carboxylic acids, amides and esters to give extremely bright electrodeposits.

21 Claims, No Drawings

ACIDIC PLATING BATH AND ADDITIVES FOR ELECTRODEPOSITION OF BRIGHT TIN

CROSS-REFERENCE

This application is a continuation-in-part of U.S. Patent Application Ser. No. 593,311, filed July 7, 1975 entitled "ACIDIC PLATING BATH AND ADDITIVES FOR ELECTRODEPOSITION OF BRIGHT TIN", now U.S. Pat. No. 3,977,949.

BACKGROUND OF THE INVENTION

The present invention relates to an aqueous acid electroplating bath for producing extremely bright, lustrous electrodeposits of tin. More specifically, the present invention relates to a brightening agent and an acid plating bath containing the brightening agent for producing bright deposits of tin and abating or eliminating pitting at extremely high current densities.

Various brightener compositions for acid tin baths containing carboxaldehydes are disclosed in several United States patents. Depending upon the particular aldehyde utilized, the electrodeposits from acid sulfate tin plating baths can vary from dull or semi-bright to bright. The choice of aldehydes also determines a plating bath's ability to produce bright plate in extremely high current density areas as well as at low current densities, such as those encountered in recesses of irregularly shaped parts.

As is the case with my copending application Ser. No. 593,311 using alkoxy naphthalene carboxaldehydes, it has been found according to the present invention that certain highly active substituted naphthalene carboxaldehydes, wherein said substituted group contains an oxygen atom connected to a compound selected from the class consisting of hydrogen, hydroxy alkyl, polyalkoxy and 3-sulfopropyl as primary brighteners, can be used in much lower concentrations than previously used aldehydes to produce electrodeposits of tin from an aqueous acid plating bath that exhibit extreme luster and brightness over a very broad current density range. Additionally, the compounds of the present invention produce much less pitting at extremely high current densities when there is little bath agitation as compared to previously known aldehydes.

SUMMARY OF THE INVENTION

Accordingly, it is an object of this invention to provide brightening agents which produce extremely bright electrodeposits of tin.

It is yet another object of the present invention to provide a substituted naphthalene carboxaldehyde as a brightening agent wherein said substituted group contains an oxygen atom connected to a compound selected from the class consisting of hydrogen, hydroxy alkyl, polyalkoxy and 3-sulfopropyl.

It is yet a further object of the present invention to provide a tin plating bath having said substituted naphthalene carboxaldehyde brightening agent which synergistically acts with carboxylic acids, amides, and esters to give extremely bright electrodepositions of tin over broad current density ranges.

It is yet a further object of the present invention to provide a tin plating bath, as above, wherein emulsifiers are utilized to disperse said group substituted brightening agent.

It is yet a further object of the present invention to provide a tin plating bath containing said substituted naphthalene carboxaldehyde brightening agent, wherein the amount of pitting is abated or eliminated at extremely high current densities when there is little bath agitation.

These and other objects of the present invention, together with the advantages thereof over existing prior art compounds and methods which will become apparent from the following specification, are accomplished by the compounds and methods herein described and claimed.

In general, a primary tin plating brightener comprises a substituted naphthalene carboxaldehyde of the following general formula:

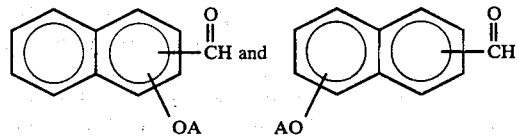

where O is oxygen and where A is selected from the class consisting of hydrogen, hydroxy alkyl having from 2 to 8 carbon atoms, polyalkoxy having 2 or 3 carbon atoms in the repeating unit wherein the number of repeating units ranges from 2 to about 40, and 3-sulfopropyl, and including from 1 to about 97 percent of at least one alpha unsaturated compound selected from the group consisting of carboxylic acids, amides, and esters for producing bright electrodeposits of tin from an aqueous acid plating bath.

Additionally, an aqueous acid tin electroplating bath, containing stannous ions comprising having dissolved therein as a brightener compound about 0.01 to about 0.2 grams/liter of a substituted naphthalene carboxaldehyde of the following general formula:

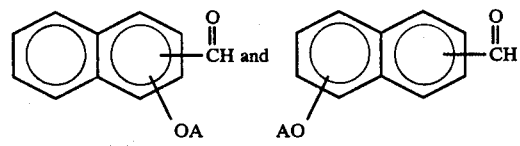

where O is oxygen and where A is selected from the class consisting of hydrogen, hydroxy alkyl having from 2 to 8 carbon atoms, polyalkoxy having 2 or 3 carbon atoms in the repeating unit wherein the number of repeating units ranges from 2 to about 40, and 3-sulfopropyl.

DESCRIPTION OF THE PREFERRED EMBODIMENTS

According to the concepts of the invention, it has been found that very bright electrodeposits can be obtained from an aqueous acid tin plating bath when an alkoxy naphthalene carboxaldehyde compound is used as a primary brightener. It has been also found that these alkoxy naphthalene carboxaldehydes act synergistically with alpha unsaturated carboxylic acids, amides and esters to produce extremely bright electrodeposits. The effect is truly synergistic in that the results obtained with this combination far exceed those of using the two types of compounds separately.

Many of the alkoxy naphthalene carboxaldehyde brighteners are available in commerce. The ones that are not can readily be prepared by one skilled in the art by chloromethylation of the appropriate naphthyl ether and conversion to the carboxaldehyde via the Sommelet reaction (See *Organic Chemistry,* Third Edition, by Feiser and Feiser . . . P. 677).

The alkoxy naphthalene carboxaldehydes of my copending invention have the following general formula:

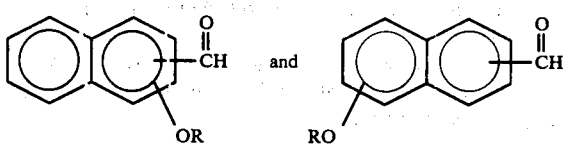

where R is methyl, ethyl, propyl, or isopropyl. Preferably, the carboxaldehyde group is located at the 1 or 2 position of the naphthalene compound. While all of the isomers exhibit brightening ability, the isomers that have the alkoxy group, either ortho or para to the carboxaldehyde group or a corresponding resonance position on the adjacent ring, are the best brighteners. The reason that these preferred compounds produce increased brightness is thought to be due to ring activation through the resonance effect of the alkoxy group. Concerning the ortho substituted aldehydes, it has been surprisingly found that they work as well as the para substituted aldehydes. In other plating systems, many ortho substituted isomers of active brighteners have a very limited effect compared to the para or meta substituted isomers. This is apparently caused by an ortho effect which either disrupts the neighboring functional group by an electronic interaction or by simple steric hindrance.

The substituted naphthalene carboxaldehydes of the present invention have the following general formula:

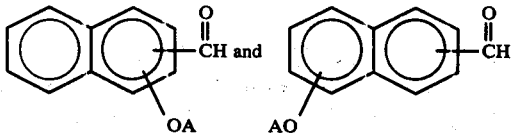

where O is oxygen and where A is selected from the class consisting of hydrogen, hydroxy alkyl, polyalkoxy and 3-sulfopropyl. The hydroxy alkyl may contain from 2 to about 8 carbon atoms with 2 or 3 carbon atoms being preferred. Examples of specific hydroxy alkyl groups include hydroxy ethyl, 2-hydroxy propyl, 2-hydroxy butyl, 2-hydroxy pentyl, 2-hydroxy hexyl, 2-hydroxy heptyl, 2-hydroxy octyl and the like. As noted above, hydroxy ethyl and hydroxy propyl are preferred, especially the 2 hydroxy isomers of these compounds, that is $-CH_2CH_2OH$, and $-CH_2CHOHCH_3$. The polyalkoxy compounds have 2 or 3 carbon atoms and include polyethoxy:-$(CH_2CH_2O)_n$-H, and polypropoxy:

$$-(CH_2\overset{\overset{CH_3}{|}}{C}HO)_n-H.$$

The number of repeating units, that is n, can range from 2 to about 40. A preferred range of n is from about 2 to about 12. Considering the 3-sulfopropyl group, it has the formula: $-CH_2CH_2CH_2SO_3Z$ where Z is hydrogen or a metal selected from group 1A or 2A of the Periodic Table of the Elements with sodium or potassium being preferred. In a plating bath, the Z portion will be in equilibrium with the bath so that not all of the sulfopropyl molecules will contain the Z portion.

As in my copending specification where R is an alkyl group, while all of the various isomers of the present OA group substituted naphthalene compound exhibit brightening ability, preferably the carboxaldehyde group is located at the 1 or 2 position while the substituted OA group is located either ortho or para to the carboxaldehyde group, or a corresponding resonance position on the adjacent ring. The increased brightness of the preferred compounds is thought to be due to ring activation through the resonance effect of the substituted OA group. The discovery that these compounds produce less pitting is thought to be attributable to their increased bath solubility provided by the highly polar substituted groups. Additionally, these compounds which contain an ortho substituted aldehyde also have been found to work as well as the para substituted aldehydes.

The syntheses, chemistry and conditions of preparing the various OA substituted naphthalene carboxaldehydes of the present invention are well documented in the chemical literature. For example, the preferred 2-hydroxy ethyl naphthalene carboxaldehydes are prepared by reacting an equal molar amount of the appropriate hydroxy naphthalene carboxaldehyde with ethylene oxide. The preferred compound of 2-hydroxy propyl naphthalene carboxaldehydes are prepared similarly by using propylene oxide in place of ethylene oxide. Other compounds can be similarly made.

The various polyalkoxy substituted naphthalene carboxaldehydes are similarly made except that they are reacted with a large excess of the oxide compound. For example, polyethoxy naphthalene carboxaldehyde is prepared by reacting one mole of the appropriate isomer of hydroxy naphthalene carboxaldehyde with from 2 to about 30 moles of ethylene oxide. Likewise, the poly(2-propoxy)naphthalene carboxaldehyde is prepared by utilizing propylene oxide in place of ethylene oxide.

The compound of 3-sulfopropoxy naphthalene carboxaldehyde is prepared by reacting the appropriate hydroxy naphthalene carboxaldehyde or its alkaline salt with an equal molar amount of propane sultone.

The very high activity of both the OR and the OA substituted naphthalene carboxaldehyde brighteners allows them to be used in much lower concentrations than other carboxaldehydes. The OR substituted brighteners of my copending invention and the OA substituted brighteners of my present invention are generally used in a bath at a concentration of about 0.01 to about 0.2 grams/liter and the preferred concentration is about 0.01 to about 0.05 grams/liter. They may be added to the bath in concentrated form or as dilute solutions in various suitable solvents such as methanol or ethanol.

Since both the OR substituted and the OA substituted brighteners exhibit limited solubility in the plating bath, emulsifying agents generally must be used to disperse them. A brightener additive mixture thus generally contains either the alkoxy (OR) substituted or the OA substituted naphthalene carboxaldehyde compound and from about 1 percent to about 96 percent by weight of the emulsifying agent based upon the total weight of the two component mixture. The types of emulsifiers or wetting agents that have been found to work quite well are listed in Table I. A range of about 2 to 40 grams/-liter of plating bath is generally sufficient.

TABLE I

| TRADE NAME | TYPE | MANUFACTURER |
|---|---|---|
| Ingepal CO-710 | Nonionic | GAF |
| Tergitol 08 | Anionic | Union Carbide |
| Miranol HS | Amphoteric | Miranol Chemical Co. |
| Amine C | Cationic | Ciba-Geigy |
| Tergitol TMN | Nonionic | Union Carbide |
| Avirol 100-E | Anionic | Standard Chemical Products, Inc. |

The preferred emulsifying agents have been found to be the nonionics made by condensing ethylene oxide with lipophilic groups such as long chain fatty alcohols, long chain fatty acids, long chain fatty amines and long chain alkyl phenols, the long chain containing from 6 to about 30 and preferably from 6 to about 20 carbon atoms. The optimum amount of ethylene oxide is about 10 to 40 moles per mole of lipophile. While these are the preferred nonionics, it is not meant to limit the invention to these types only. For example, ethylene oxide derivatives of naphthols and polysaccharides also perform satisfactorily. In addition, propylene oxide condensates also are considered part of this invention.

All of the alpha unsaturated carboxylic acids, alpha unsaturated amides and alpha unsaturated esters generally are readily available in commerce. Table II lists the preferred compounds of this group.

TABLE II

Cinnamic acid
Acrylic acid
Methacrylic acid
Crotonic acid
Acrylamide
Methacrylamide
Methyl acrylate
Methyl methacrylate These alpha unsaturated compounds are generally added as aqueous or alcoholic (e.g. methyl, ethyl, propyl and isopropyl alcohol) solutions to insure good dispersion in the plating bath. They are used at a concentration of about 0.02 to about 5 grams/liter and the preferred concentration is about 0.2 to about 2 grams/-liter. These compounds may also be a part of a brightener agent mixture which contains the alkoxy (OR) substituted or the OA substituted naphthalene carboxaldehyde and from about 1 to about 97 percent by weight of the alpha unsaturated carboxylic acids, amides, or esters by weight of the total weight of the mixture. Naturally, any of the above emulsifying agents may also be added to this mixture wherein the amount of the emulsifying agent ranges from about 1 to about 96 percent by weight based upon the total weight of the mixture. As before with the emulsifiers, the mixture of solely the brightener agent and the unsaturated carboxylic acids, amides and esters, with or without any emulsifying agent, contains a smaller amount of the alpha unsaturated compounds as opposed to the above-mentioned bath concentration.

Conventional additive agents known to the art such as aromatic and aliphatic ketones and aldehydes may be used in conjunction with the brighteners of this invention, but it has been generally found that they do not provide any additional brightening.

While the alkoxy (OR) and the OA substituted brightening agents of this invention are effective in many aqueous acid tin plating bath formulations, it is preferred to use any of the basic baths described in the following examples. In general, a source of stannous ions, such as stannous sulfate, is present. A suitable amount is from about 10 to about 100 grams per liter. Also present is sulfuric acid. A suitable amount is from about 20 to about 260 grams per liter.

Examples I through VI and Table III relate to compositions containing the alkoxy (OR) naphthalene carboxaldehyde brightening agents.

EXAMPLE I

| BATH COMPOSITION | CONCENTRATION IN GRAMS/LITER |
|---|---|
| Stannuous sulfate | 35 |
| Sulfuric acid | 100 |
| 4-methoxy-1-naphthaldehyde | 0.03 |
| Ingepal CO-710 | 15 |
| Cinnamic acid | 0.1 |

EXAMPLE II

| BATH COMPOSITION | CONCENTRATION IN GRAMS/LITER |
|---|---|
| Stannuous sulfate | 30 |
| Sulfuric acid | 180 |
| 2-methoxy-1-naphthaldehyde | 0.05 |
| Amine C | 20 |
| Methacrylic acid | 0.75 |

EXAMPLE III

| BATH COMPOSITION | CONCENTRATION IN GRAMS/LITER |
|---|---|
| Stannuous sulfate | 40 |
| Sulfuric acid | 200 |
| 4-methoxy-1-naphthaldehyde | 0.05 |
| Tergitol 08 | 10 |
| Tergitol TMN | 10 |
| Acrylic acid | 0.4 |

EXAMPLE IV

| BATH COMPOSITION | CONCENTRATION IN GRAMS/LITER |
|---|---|
| Stannuous sulfate | 30 |
| Sulfuric acid | 180 |
| 2-methoxy-1-naphthaldehyde | 0.03 |
| Ingepal CO-710 | 20 |
| Methacrylic acid | 0.75 |

EXAMPLE V

| BATH COMPOSITION | CONCENTRATION IN GRAMS/LITER |
|---|---|
| Stannuous sulfate | 35 |
| Sulfuric acid | 180 |
| 4-methoxy-1-naphthaldehyde | 0.03 |
| Ingepal CO-710 | 20 |
| Methacrylamide | 0.02 |

EXAMPLE VI

| BATH COMPOSITION | CONCENTRATION IN GRAMS/LITER |
|---|---|
| Stannuous sulfate | 30 |
| Sulfuric acid | 180 |
| 4-methoxy-1-naphthaldehyde | 0.03 |

-continued

| BATH COMPOSITION | CONCENTRATION IN GRAMS/LITER |
|---|---|
| Miranol HS | 20 |
| Methacrylic acid | 0.75 |

All testing was done in a conventional 267 ml. Hull cell, using steel cathode panels and tin anodes. A current of two amperes was used for five minutes at temperatures ranging from 70° F to 85° F. The electrodeposits from the tests that were run on the baths of Examples I through V varied from bright to extremely bright. The best results were obtained from the baths of Example I through VI. In these cases the bright ranges extended from about one ampere/sq. ft. to well over 100 amperes/sq. ft.

Table III discusses the results from Example I through VI in more detail along with additional tests conducted under the same conditions.

TABLE III

| ALPHA UNSATURATED COMPOUND | BRIGHTENER | EMULSIFIER | RESULTS |
|---|---|---|---|
| None | None | Igepal CO-710 | Dark and spongy higher than 40 amps./sq. ft. Dull from 0 to 40 amps./sq. ft. |
| None | 4-methoxy-1-naphthaldehyde | Ingepal CO-710 | Dull to semibright from 1 to 90 amps./sq. ft. Very dull from 90 amps./sq. ft. |
| Cinnamic acid | 4-methoxy-1-naphthaldehyde | Ingepal CO-710 | Bright from 3 to 100 amps./sq. ft. |
| Methacrylic acid | 4-methoxy-1-naphthaldehyde | Amine C | Extremely bright from 1 to over 100 amps./sq. ft. |
| Acrylic acid | 4-methoxy-1-naphthaldehyde | Terigitol 08 & Terrigitol TMN | Extremely bright from 1 to over 100 amps./sq. ft. |
| Methacrylic acid | 2-methoxy-1-naphthaldehyde | Ingepal CO-710 | Extremely bright from 1 to over 100 amps./sq. ft. |
| Methacrylamide | 4-methoxy-1-naphthaldehyde | Ingepal CO-710 | Extremely bright from 3 to 100 amps./sq. ft. |
| Crotonic acid | 4-methoxy-1-naphthaldehyde | Ingepal CO-710 | Semibright from 0 to 16 amps./sq. ft. Bright from 16 to over 100 amps./sq. ft. |
| Methacrylic acid | 2-methoxy-1-naphthaldehyde | Miranol HS | Semibright from 0 to 12 amps./sq. ft., bright from 12 to 40 amps./sq. ft., and extremely bright from 40 to 100 amps./sq.ft. |
| Methyl acrylate | 4-methoxy-1-naphthaldehyde | Ingepal CO-710 | Bright from 3 to over 100 amps./sq. ft. |
| Methacrylic acid | 4-methoxy-1-naphthaldehyde | Avirol 100-E | Semibright from 0 to 3 amps./sq. ft. and extremely bright from 3 to 100 amps./sq. ft. |

**All tests listed in this Table were run in a plating bath containing 30 grams of stannuous sulfate/liter and 180 grams of sulfuric acid/liter.

Examples A through D and Table A relate to compositions containing the OA group substituted naphthalene carboxaldehyde brightening agents.

As before with the alkoxy brightener, all testing was done in a conventional 267 ml. Hull cell, using steel cathode panels and tin anodes. A current of two amperes was used for five minutes at temperatures ranging from 70° F to 85° F. The electrodeposits from the tests that were run on the baths of Examples A through D varied from bright to extremely bright. Table A discusses the results obtained.

EXAMPLE A

| BATH COMPOSITION | CONCENTRATION IN GRAMS/LITER |
|---|---|
| Stannous sulfate | 35 |
| Sulfuric acid | 100 |
| 2-hydroxy-1-naphthalene carboxaldehyde* | 0.02 |
| Igepal CO-710 | 15 |
| Acrylic acid | 0.4 |

*Group A is H

EXAMPLE B

| BATH COMPOSITION | CONCENTRATION IN GRAMS/LITER |
|---|---|
| Stannous sulfate | 30 |
| Sulfuric acid | 180 |
| 2-(3-sulfopropoxy)-1-naphthalene carboxaldehyde* | 0.04 |
| Amine C | 20 |
| Methacrylic acid | 0.75 |

*Group A is 3-sulfopropoxy

EXAMPLE C

| BATH COMPOSITION | CONCENTRATION IN GRAMS/LITER |
|---|---|
| Stannous sulfate | 40 |
| Sulfuric acid | 200 |
| 2-(2-hydroxy propoxy)-1-naphthalene carboxaldehyde* | 0.03 |
| Igepal CO-710 | 20 |
| Methacrylic acid | 1.0 |

*Group A is 2-hydroxy propyl

EXAMPLE D

| BATH COMPOSITION | CONCENTRATION IN GRAMS/LITER |
|---|---|
| Stannous sulfate | 35 |
| Sulfuric acid | 180 |
| 1-hydroxy-2-naphthalene carboxaldehyde* | 0.02 |
| Miranol HS | 20 |
| Acrylic acid | 0.3 |

*Group A is H

TABLE A

| TEST BATH USED | RESULTS |
|---|---|
| Bath from Example A | Bright from 3 to over 100 amps/sq.ft. with only minor amount of pitting from 70 amps/sq. ft. and over. |
| Bath from Example B | Extremely bright from 1 to over 100 amps/sq. ft. with only slight evidence of pitting at 95 amps/sq. ft. and over. |

TABLE A-continued

| TEST BATH USED | RESULTS |
|---|---|
| Bath from Example C | Extremely bright from 1 to well over 100 amps/sq. ft. with only slight evidence of pitting at 95 amps./sq. ft. and over. |
| Bath from Example D | Bright from 3 to over 100 amps/sq. ft. with only slight amount of pitting at 65 amps/sq. ft. and over. |

As apparent from Table A, only slight evidence of pitting at high current densities were obtained using the OA substituted brighteners of the present invention.

Having thus described this invention in such full, clear, concise and exact terms as to enable any person skilled in the art to which it pertains to make and use the same, and having set forth the best mode contemplated of carrying out this invention in accordance with the patent statutes, the subject matter which is regarded as being my invention is particularly pointed out and distinctly claimed in what is claimed, it being understood that equivalents or substitutions for parts of the above-specifically described embodiment of the invention may be made without departing from the scope and concept of the invention as set forth in the appended claims.

What is claimed is:

1. A primary tin plating brightening additive, comprising:

a substituted naphthalene carboxaldehyde of the following general formula:

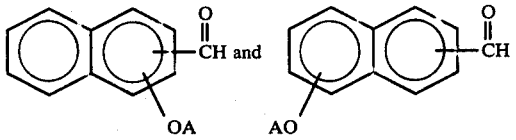

where O is oxygen and where A is selected from the class consisting of hydrogen, hydroxy alkyl, polyalkoxy and 3-sulfopropyl, said alkyl containing from 2 to 8 carbon atoms, said polyalkoxy containing from 2 or 3 carbon atoms in the repeating unit wherein the number of repeating units ranges from 2 to about 40 per molecule, and said 3-sulfopropyl compound having the formula $—CH_2CH_2CH_2SO_3Z$ where Z is selected from the class consisting of hydrogen, Group 1A, and Group 2A of the Periodic Table, including from 1 to about 97 percent of at least one alpha unsaturated compound selected from the group consisting of carboxylic acids, amides, and esters for producing bright electrodeposits of tin from an aqueous acid plating bath.

2. The additive of claim 1, wherein said hydroxy alkyl group contains 2 or 3 carbon atoms and including from about 1 to about 96 percent of at least one emulsifying agent selected from the group consisting of nonionic, cationic, anionic, and amphoteric emulsifying agents.

3. The additive of claim 2, wherein said emulsifying agent is a nonionic emulsifying agent.

4. An aqueous, acid tin electroplating bath containing stannous ions and sulfuric acid, comprising:

having dissolved therein as a brightener compound about 0.01 to about 0.2 grams/liter of a substituted naphthalene carboxaldehyde of the following general formula:

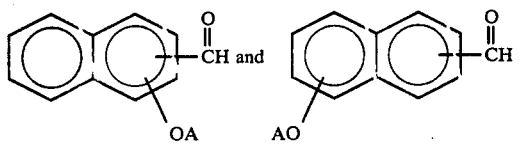

where O is oxygen and where A is selected from the group consisting of hydrogen, hydroxy alkyl, polyalkoxy and 3-6 sulfopropyl, said alkyl having from 2 to 8 carbon atoms, said polyalkoxy containing 2 or 3 carbon atoms in the repeating unit wherein the number of repeating units ranges from 2 to about 40 per molecule, and said 3-sulfopropyl compound having the formula $—CH_2CH_2CH_2SO_3Z$ where Z is selected from the class consisting of hydrogen, Group 1A, and Group 2A of the Periodic Table.

5. The bath of claim 4, wherein said hydroxy alkyl group contains 2 or 3 carbon atoms, including from 2 to about 40 grams/liter of an emulsifying agent so that said substituted naphthalene carboxyaldehyde is solubilized.

6. The bath of claim 5, having dissolved therein about 0.02 to about 5 grams/liter of at least one alpha unsaturated compound selected from the class consisting of carboxylic acids, amides and esters.

7. The bath of claim 6, wherein said alpha unsaturated compounds are selected from the group consisting of cinnamic acid, acrylic acid, methacrylic acid, crotonic acid, acrylamide, methacrylamide, methyl acrylate and methyl methacrylate.

8. The bath of claim 7, wherein said emulsifying agent is a nonionic emulsifying agent.

9. The bath of claim 7, wherein said emulsifying agent is selected from the group consisting of nonionic, anionic, cationic and amphoteric emulsifying agents.

10. The bath of claim 7, wherein said emulsifying agent is an alkyl phenol condensed with about 10 to 40 moles of ethylene oxide per mole of alkyl phenol.

11. The bath of claim 7, wherein the substituting group on said naphthalene carboxaldehyde is ortho or para to the carboxaldehyde group.

12. The bath of claim 11, wherein said carboxaldehyde group is in the one position on the naphthalene ring.

13. The bath of claim 11, wherein said carboxaldehyde group is in the two position of the naphthalene ring.

14. The bath of claim 11, wherein A is hydrogen.

15. The bath of claim 11, where A is 2-hydroxy ethyl.

16. The bath of claim 11, where A is 2-hydroxy propyl.

17. The bath of claim 11, where A is 3-sulfonate propyl wherein Z is selected from the class consisting of hydrogen, sodium and potassium.

18. The bath of claim 7, wherein the amount of said substituted carboxaldehyde ranges from about 0.01 to about 0.05 grams/liter.

19. The bath of claim 7, wherein the amount of alpha unsaturated compound ranges from about 0.02 to about 2.0 grams/liter.

20. The bath of claim 7, wherein the amount of the stannous ions ranges from about 10 to about 100 grams/liter.

21. The bath of claim 7, wherein the amount of the sulfuric acid ranges from about 20 to about 260 grams/liter.

* * * * *